US005809617A

United States Patent [19]

Harris et al.

[11] Patent Number: 5,809,617

[45] Date of Patent: Sep. 22, 1998

[54] MOUNTING FOR MOVABLE MEMBERS

[76] Inventors: Patrick William Harris; Maureen Anne Harris, both of C/—Gentech Services, 7 Killick Street, Kunda Park, Queensland, 4556, Australia

[21] Appl. No.: 656,202

[22] PCT Filed: Dec. 6, 1994

[86] PCT No.: PCT/AU94/00755

§ 371 Date: Jun. 6, 1996

§ 102(e) Date: Jun. 6, 1996

[87] PCT Pub. No.: WO95/16096

PCT Pub. Date: Jun. 15, 1995

[30] Foreign Application Priority Data

Dec. 6, 1993 [AU] Australia ..... PM2826

[51] Int. Cl.[6] ..... E05D 5/10; E05D 7/10; E05D 11/10

[52] U.S. Cl. ..... 16/273; 16/267; 16/386; 49/397; 49/399

[58] Field of Search ..... 16/273, 267, 386, 16/93 R; 160/232, 235; 49/397, 399; 312/349, 350

[56] References Cited

U.S. PATENT DOCUMENTS

| | | | |
|---|---|---|---|
| 2,683,892 | 7/1954 | Gorman | 16/386 |
| 2,834,072 | 5/1958 | Miller | 160/235 |
| 2,968,829 | 1/1961 | Meddick | 16/273 |
| 3,015,839 | 1/1962 | Eskridge et al. | 16/273 |
| 4,175,357 | 11/1979 | Goldhaber | 49/397 |
| 5,448,799 | 9/1995 | Stein, Jr. | 160/235 |

FOREIGN PATENT DOCUMENTS

| | | | |
|---|---|---|---|
| 2623553 | 5/1989 | France . | |
| 3637244 | 4/1988 | Germany . | |
| 613397 | 11/1948 | United Kingdom | 16/93 R |
| 679757 | 9/1952 | United Kingdom | 16/93 R |
| 1239509 | 7/1971 | United Kingdom | 16/273 |

*Primary Examiner*—Randolph A. Reese
*Assistant Examiner*—Donald M. Gurley
*Attorney, Agent, or Firm*—Abelman, Frayne & Schwab

[57] ABSTRACT

The invention comprises an apparatus for connecting two elongate members (16, 10) in parallelism and so that one may be moved relative to the other, the other member (10) being adapted to be rigidly mounted and having a neck portion (12*a*) extending longitudinally and terminating laterally in a longitudinal bead (11) engageable in a longitudinal groove (22) of a longitudinal edge flange of the one movable member (16), there being provided an anti-friction contact strip (17) between the members (16, 10), the strip (17) being substantially tubular or arcuate in cross-section with a longitudinal slit (28) through which the neck portion (12*a*) of the other member (10) extends when the two members are connected, the parts being so made and arranged that the strip (17) may be fitted by end-wise longitudinal sliding into and along the groove (22) and about and along the bead (11), and the two elongate members (16, 10) and interposed contact strip (17) are then restrained against separation by forces applied transversely thereof. In some embodiments, the elongate members (16, 10) are hingedly connected about a longitudinal axis (19) while in other embodiments they are connected for relative sliding movement lengthwise.

1 Claim, 4 Drawing Sheets

MOUNTING FOR MOVABLE MEMBERS

TECHNICAL FIELD OF THE INVENTION

THIS INVENTION relates to mountings for movable members, and it has more particular reference to a mounting connection between two members whereby one may be moved relative to the other. In its broadest applications, the connection may embrace both the hinged connection of members and also the sliding movement of one member relative to the other.

BACKGROUND ART

There is described and illustrated in our co-pending Australian Patent Application No. 656,040 entitled "SLIDING DOOR AND WINDOW SECURITY MEANS" an emergency exit grille developed to provide easy escape from inside premises in the case of fire, opening of the sliding window in a sliding action causing the emergency grille to swing hingedly open automatically to allow the occupant to exit. It is naturally desired that the grille be able to swing open to adequate extent, and we have accordingly sought to develop improved hinges usable in this application. At the same time, we have come to realize the need for improved hinging actions in other applications, particularly where basic constructions make it difficult to obtain a hinging action through a full quarter-circle or through greater than ninety degrees. We have also discovered that components used in certain hinge arrangements which we are developing can be expected to prove useful in other mounting connections.

Accordingly, our invention has been devised with the principal object of providing such novel features in relation to mounting connections generally that our new concepts can be applied to either mounting connections having hinging features or to mounting connections in which one member (such as a panel) is slidable. Since our "EXIGRIL" (Registered Trade Mark) emergency exit of the aforementioned patent application involves a hinged escape panel on a sliding window, it will be appreciated that the components of this invention will be found particularly applicable thereto. Other objects and advantages of this invention will become apparent from the descriptions herein.

DISCLOSURE OF THE INVENTION

With the foregoing and other objects in view, the invention resides broadly, according to one aspect, in means for connecting two elongate members in parallelism and so that one may be moved relative to the other, said other member being adapted to be rigidly mounted and having a neck portion extending longitudinally and terminating laterally in a longitudinal bead engageable in a longitudinal groove of a longitudinal edge flange of said one or movable member, there being provided anti-friction contact strip means between said members, said strip means being substantially tubular or arcuate in cross-section with longitudinal alit means through which paid neck portion of said other member extends when the two members are connected, the parts being so made and arranged that said strip means may be fitted by end-wise longitudinal sliding into and along said groove and about and along said bead, and the two elongate members and interposed contact strip means are then restrained against separation by forces applied transversely thereof.

While the anti-friction contact strip means could be made up of a number of end to end strips, there is preferably provided a single length of anti-friction material having said longitudinal slit means in the form of a continuous slit throughout its length. Thus, the invention can be expressed according to another aspect as a mounting connection between two members whereby one may be moved relative to the other, comprising a first rigidly mounted member and a second or movable member connected thereto with an anti-friction contact strip therebetween of partial sleeve-like or tubular form, said strip having a longitudinal slit through which the said one member extends to its rigid mounting.

In that event, the mounting connection can be between a movable member and a fixed member, wherein the part sleeve-like anti-friction strip is continuous along a sliding rail, panel or the like constituting the movable member and it has frictional contact along the rigid first member, which is in the form of a fixed guide rail, at top, bottom and one side of the rail, the other side of the rail being its rigid mounting side, the part sleeve-like anti-friction strip having arcuate inner surfaces to engage the rigid rail at top, bottom and one side, thus providing anti-friction sliding of the movable rail along the fixed rail.

According to another embodiment of the invention, the part sleeve-like anti-friction strip is continuous along both a hinge member and a fixed rail or hinge pin on which it is mounted, the strip being interposed in such manner that the hinge member turns substantially concentrically about the fixed rail while being spaced therefrom by the anti-friction strip at all stages of rotation. A special feature of this embodiment of the invention is that the internal surf ace of the hinged member is so shaped as to co-operate with at least one longitudinal rib on the exterior of the anti-friction strip to afford a lost-motion action permitting the hinge to turn through a greater angle than would otherwise be the case taking into account the rigid mounting arrangements for the fixed rail.

It is preferred at this stage in the developments that the anti-friction contact strip be a plastics extrusion of aquilanitrile butadiene styrene (Trade Mark "A.B.S.") or of aquilanitrile styrene acrylic (Trade Mark "LURANS") or materials having equal sliding abilities. The fixed and movable members can in most cases be suitably of extruded aluminium or the like.

So far as hinged connections are concerned, the invention provides means for connecting two elongate members in parallelism and so that one may be moved hingedly relative to the other about a longitudinal axis, said other member being adapted to be rigidly mounted and having a neck portion extending longitudinally and terminating laterally in a longitudinal bead providing a hinge axis and engageable in a longitudinal groove of a longitudinal edge flange of said one or hingedly movable member, there being provided anti-friction contact strip means between said members, said strip means being substantially tubular or arcuate in cross-section with longitudinal slit means through which said neck portion of said other member extends when the two members are connected, the parts being so made and arranged that said strip means may be fitted by end-wise longitudinal sliding into and along said groove and about and along said bead, and the two elongate members and interposed contact strip means are then restrained against separation by forces applied transversely thereof.

In hingedly connected embodiments, where the strip means is a single length of anti-friction material having the longitudinal slit means in the form of a continuous slit throughout its length, the single length preferably being moulded in one piece, it is preferred that the anti-friction strip member has a body formed with concentric inner and outer faces viewed in cross-section, the inner surface of the groove of the hinged member and the outer surface of the bead of the fixed member being arcuate to correspond therewith.

In that event suitably the outer surface of the anti-friction strip has a longitudinal rib or spline throughout its length and the inner surface of the groove of the movable member has a longitudinal recess to accommodate said rib or spline, the latter having a lesser arcuate dimension than the recess so that the recess permits relative turning of the anti-friction strip in a lost-motion to maximize the angle of hinging.

Other features and other embodiments of the invention will be hereinafter apparent.

DESCRIPTION OF THE DRAWINGS

In order that the invention may be more readily understood and put into practical effect, reference will now be made the accompanying drawings wherein.

Figure 1:
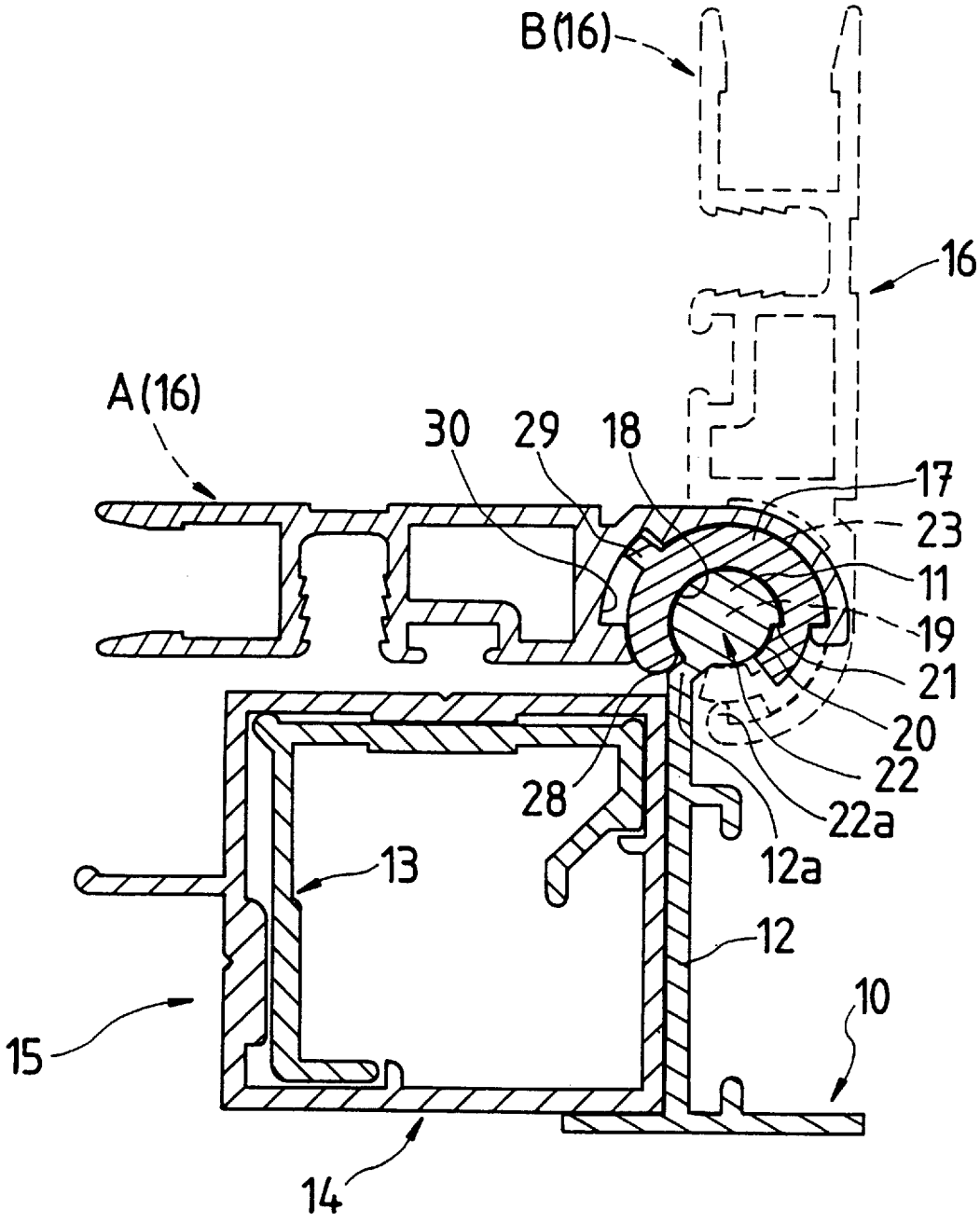
FIG. 1 shows in sectional view the assembled components according to one embodiment of the invention for hingedly mounting a panel to a frame, the view being suitably a plan view in relation to hinging the panel about a vertical axis, both closed and almost open attitudes being shown.

Referring initially to FIGS. 1 to 7 of the drawings, the fixed member 10 has a hinge bead 11 and mounting body 12 adapted to be secured relative to frame members 13 and 14 to constitute a jamb or equivalent structure 15 to which the hinged panel 16 is to be hingedly connected about a vertical axis for movement between the closed attitude indicated by the letter "A" and the almost-fully open attitude denoted by the letter "B". The fixed member 10 and the hinged panel 16 are suitably aluminium extrusions and are interconnected by an interposed plastic anti-friction strip 17 which is preferably made of one of the plastics previously mentioned, namely A.B.S. or LURANS.

Figure 1A:
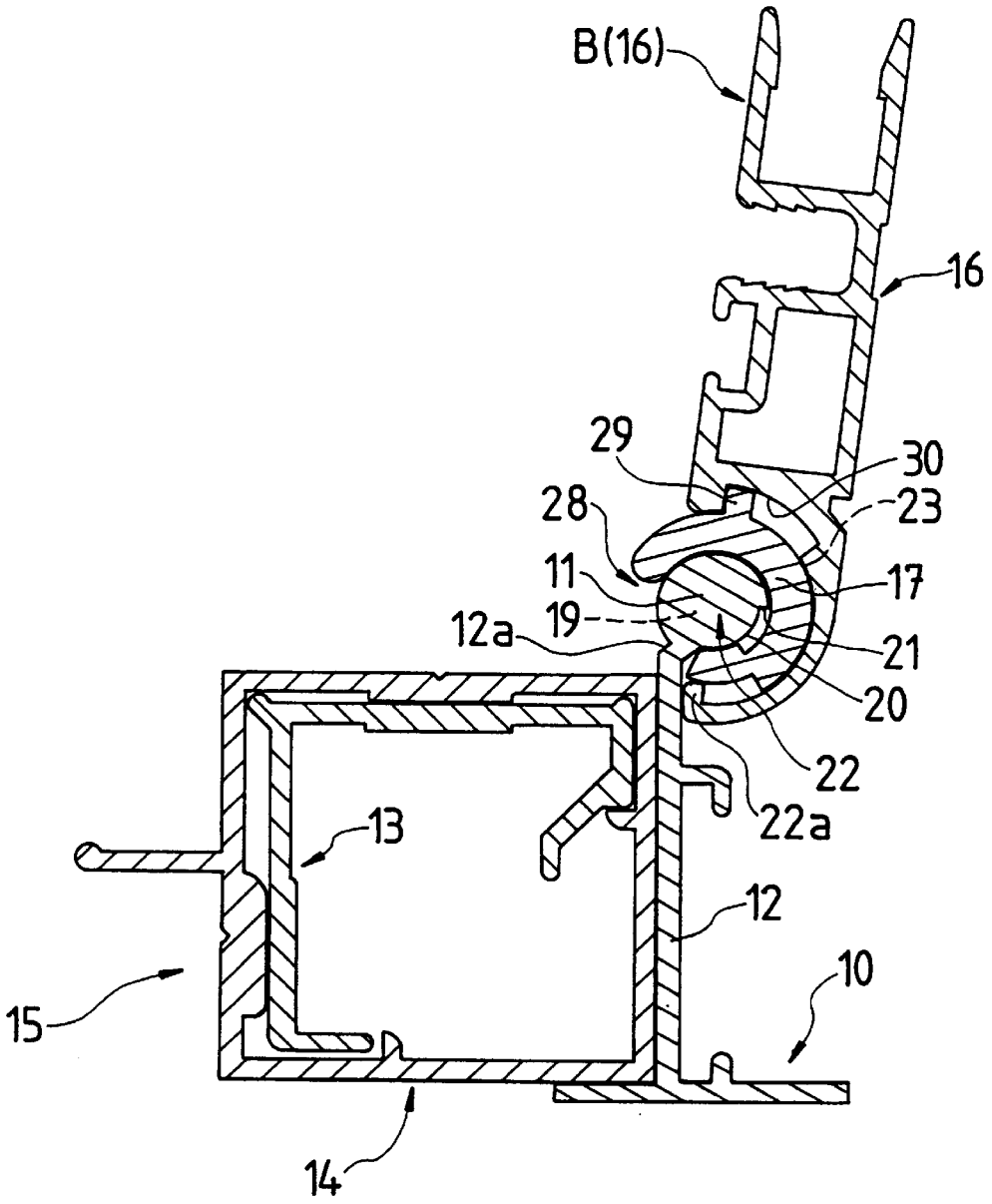
FIG. 1A is the same as FIG. 1 but showing only the fully-open attitudes of the components.
Figure 3:
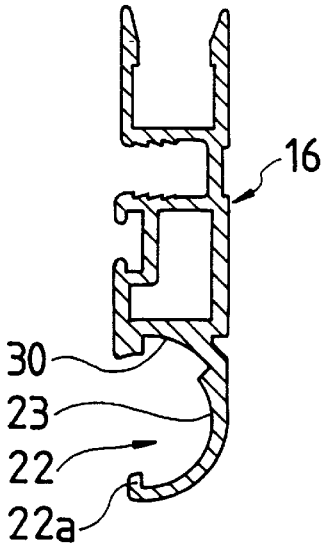
FIGS. 2, 3 and 4 are separate sectional views of the fixed metal frame member, the hinged metal panel member, and the plastic anti-friction strip, respectively, as shown assembled in FIG. 1.
Figure 6:
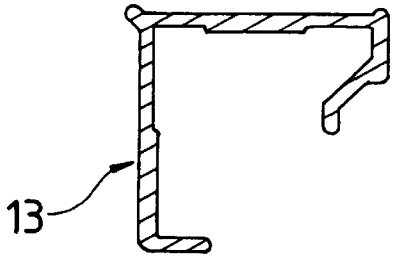
FIGS. 6 and 7 show in cross-section two of the additional frame members of FIG. 1 in separated relationship.
Figure 2:
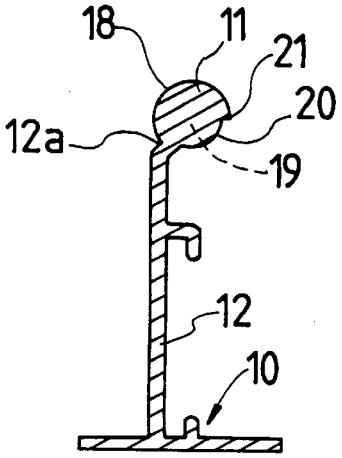
Figure 7:
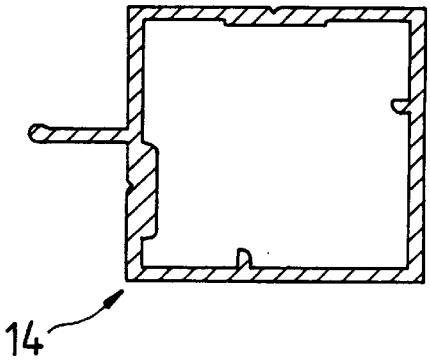
Figure 4:
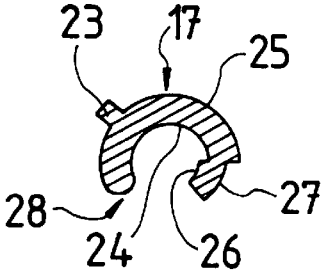
Figure 5:
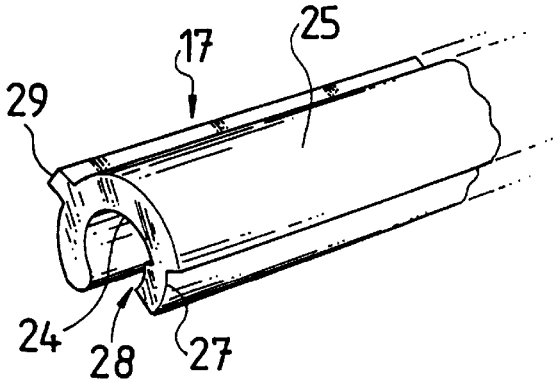
FIG. 5 shows in perspective view the anti-friction strip of FIG. 4.

It will be noted from the drawings that the fixed member 10 has its hinge bead 11 offset from the mounting body 12 so that the latter is aligned with the "inner" face of the panel 15 when open in order to maximise the opening and can be moved slightly more open as shown in FIG. 1A if required by virtue of the features explained hereafter. The hinge bead 11 has a circular cross-section at 18 about the offset axis 19, as well as a circular cross-section to a lesser radius at 20 about the same axis, with a shoulder 21 therebetween in consequence, the two curved parts 18 and 20 being on opposite sides of the neck portion 12*a* of the hinge bead 11 joining to the mounting body 12.

It will be seen from FIG. 1 that the hinged panel member 16 receives the hinge bead 11 in an opening 22 having a concentric surface 23 relative to the axis 19, while the interposed anti-friction strip 17 has concentric inner and outer surfaces 24 and 25 respectively, plus reduced diameter sections 26 and 27. In this way the rotation is limited by stop means where shoulders inter-engage, the opening 22 of the hinged panel 16 having a restrictive terminal shoulder 22*a* also for the same purpose. Most importantly, at all times the anti-friction strip 17 will prevent metal-to-metal contact and facilitate rotational abilities, and the neck portion 12*a* of the fixed member 10 will extend through the longitudinal mouth or slit 28 of the strip 17, this being continuous longitudinal slit means as aforementioned.

It will be seen that the strip 17 has an external longitudinal spline or rib 29 of narrow width locating in a circumferentially extended recess 30 in the surface 23 of the hinged panel 16 so that the parts may be moved with a form of lost-motion action taking over to extend the degree of rotation which is possible as shown in FIG. 1A. In effect, the connection between the relatively rotatable members is via the anti-friction strip 17 which makes all contact at the three locations, firstly opposite the mounting neck 12*a,* and then at both opposite sides of the neck.

The invention provides in all embodiments that the cross-sections of the connector strip 17, movable member groove 22 and bead 11 are such that assembly is achieved by endwise insertions, whereafter the parts cannot be separated by applying forces transversely.

Figure 8:
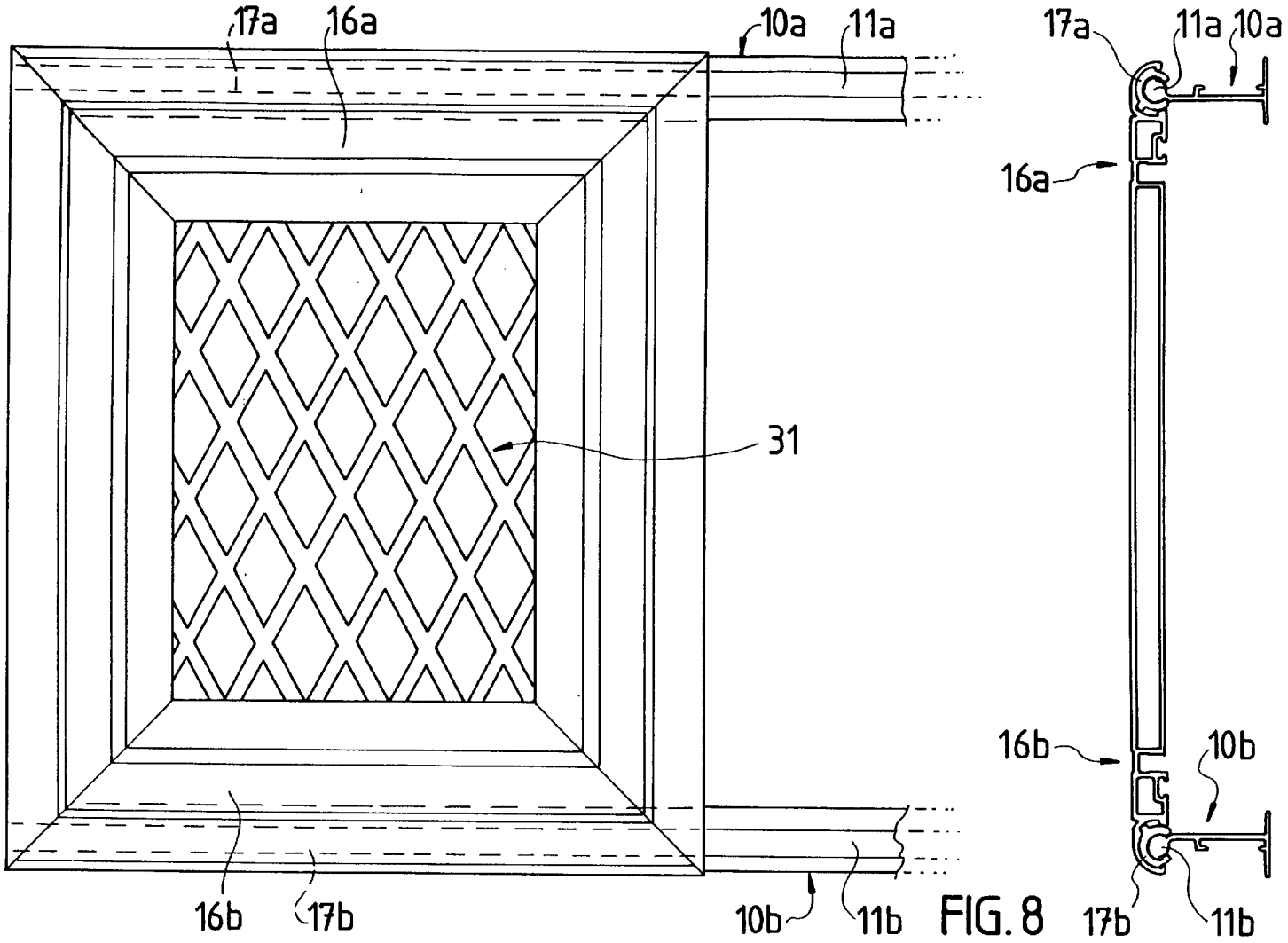
FIG. 8 shows the assembled components of a second embodiment of the invention applied to a sliding security grille, viewed from inside a building, with cross-sections of the sliding components at top and bottom being shown diagrammatically at the right-hand side by way of appendage.

The same considerations apply to the relatively slidable embodiment of FIG. 8 in which a sliding grille and grille frame 31 utilises upper and lower horizontal frame members 16*a* and 16*b* substantially identical with the hinged member 16 of FIG. 1 but always lying in the one vertical plane of the grille. The members 16*a* and 16*b* provide mountings to which are secured anti-friction strips 17*a* and 17*b* fitting around the hinge beads 11*a* and 11*b* of fixed frame members 10*a* and 10*b*. The anti-friction strips extend for the width of the grille in the sliding direction so that the sliding frame of metal never touches the slide rails of metal which extend across and beyond the opening for the panel, the relative dispositions in operation being shown at the right of FIG. 8.

Use and operation of both embodiments will be clear from the drawings taken in conjunction with the preceding descriptions, but it will be apparent that many other embodiments may be made involving various alternatives in constructional detail and design, as will be readily apparent to persons skilled in the art, and without departing from the broad scope and ambit of the invention, the general nature of which ham been set forth herein.

We claim:

1. Means for connecting two elongate members in parallelism and so that one may be moved hingedly relative to the other about a longitudinal axis, said other member being adapted to be rigidly mounted and having a neck portion extending longitudinally and terminating laterally in a longitudinal bead providing a hinge axis and engageable in a longitudinal groove of a longitudinal edge flange of said one hingedly movable member, there being provided anti-friction contact strip means between said members, said strip means being substantially tubular or arcuate in cross-section with longitudinal slit means through which said neck portion of said other member extends when the two members are connected, said strip means being a single length of anti-friction material having said longitudinal slit means in the form of a continuous slit throughout its length, said strip means having a body formed with concentric inner and outer faces viewed in cross-section, the inner surface of the groove of the hinged member and the outer surface of the bead of the fixed member being arcuate to correspond therewith, the parts being so made and arranged that said strip means may be fitted by end-wise longitudinal sliding into and along said groove and about and along said bead, and the two elongate members and interposed contact strip means are then restrained against separation by forces applied transversely thereof, the outer surface of the anti-friction strip having a longitudinal rib or spline throughout its length and the inner surface of the groove of the movable member having a longitudinal recess to accommodate said rib or spline, the latter having a lesser arcuate dimension than the recess so that the recess permits relative turning of the anti-friction strip in a lost-motion action to maximise the angle of hinging.

* * * * *